US005082149A

United States Patent [19]

Cross

[11] Patent Number: 5,082,149

[45] Date of Patent: Jan. 21, 1992

[54] DISPENSER AND PUMP TYPE CONTAINERS

[75] Inventor: Kenneth M. Cross, Penshurst, Australia

[73] Assignee: 3C Chemical Labaratories Pty Ltd., Wales, Australia

[21] Appl. No.: 578,296

[22] Filed: Sep. 6, 1990

[30] Foreign Application Priority Data

Sep. 6, 1989 [AU] Australia ..... PJ6205

[51] Int. Cl.[5] ..... B05B 17/00

[52] U.S. Cl. ..... 222/162; 222/180; 222/402.13

[58] Field of Search ..... 222/180, 181, 182, 183, 222/321, 402.1, 402.13, 402.15, 575, 162

[56] References Cited

U.S. PATENT DOCUMENTS 2,664,088 12/1953 Hoch ..... 222/575
3,161,196 12/1964 Belkow ..... 222/402.15
3,549,055 12/1970 Gatland ..... 222/182
4,111,338 9/1978 Cheng et al. ..... 222/402.13
4,223,812 9/1980 van Lit ..... 222/180
4,678,106 7/1987 Newell et al. ..... 222/182
4,765,515 8/1988 Lippman ..... 222/162

*Primary Examiner*—Donald T. Hajec
*Assistant Examiner*—Shari Wunsch
*Attorney, Agent, or Firm*—Sterne, Kessler, Goldstein & Fox

[57] ABSTRACT

A dispenser for a pump-type container comprises a case having at least one wall mounting bracket and a floor surrounded by upright side walls. A lid hinged to the case has a peripheral skirt at least partially covering an upper portion of the case. The lid has a rest position and a depressed position, with a clearance being provided between the lid and the case when the lid is in the rest position. An aperture is formed in the lid and adapted to receive a nozzle of a pump-type container, such that the clearance between the lid and the case is sufficient to activate a pump mechanism of a pump bottle located within the case when the lid is depressed.

12 Claims, 16 Drawing Sheets

DISPENSER AND PUMP TYPE CONTAINERS

FIELD OF THE INVENTION

The present invention pertains to liquid and lotion dispensers and more particularly to a dispenser which is adapted to receive a pump-type container.

OBJECT OF THE INVENTION

It is an object of the invention to provide a dispenser which is adapted to receive a pump-type container.

It is a further object of the invention to provide a dispenser which can accept a pump-type container in either the upright or inverted position.

It is another object of the invention to provide a container and nozzle which are adapted to the dispensers of the present invention.

SUMMARY OF THE INVENTION

A dispenser is provided having a hinged lid and a case. The lid of the dispenser is provided with a central opening which is sized to receive the dispensing nozzle of a pump-type container.

In a second embodiment of the invention a second opening is provided in the base of the case, whereby the second opening is also sized to receive the dispensing nozzle of a pump-type container.

In a third embodiment, an upright rim is provided in the interior of the case surrounding the second opening. The upright rim is sized to accommodate the dispensing flange of the pump-type container, but is smaller than the diameter of the container.

In a fourth embodiment, the floor of the case is provided with an upright ridge. A bottle whose base includes a medial groove is adapted to pivot back and forth on the ridge when the hinged lid is depressed.

In a fifth embodiment, the hinged lid is provided with a hinged plate having an aperture formed therein.

In a sixth embodiment, a container is provded with a base having a groove formed therein.

In a seventh embodiment, a nozzle is provided with a sleeve surrounding it. The sleeve includes a portion which extends beyond the nozzle, the extending portion having a plurality of radially disposed openings formed therein.

In an eighth embodiment, the case is provided with a pneumatic bulb.

In a ninth embodiment, the case and lid are provided with a piston and cylinder arrangement.

BEST MODE AND OTHER EMBODIMENTS OF THE INVENTION

Figure 1:
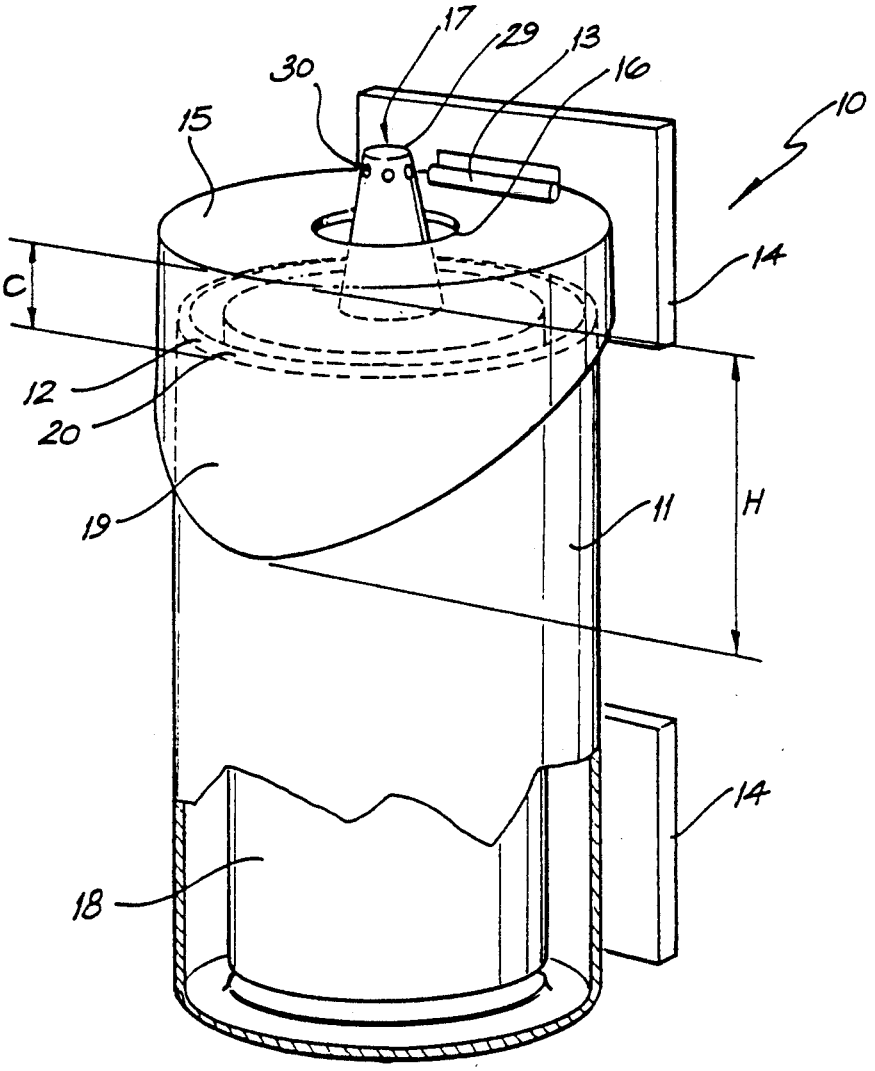
FIG. 1 is a perspective view of a pump pack dispenser according to the teachings of the present invention.

As shown in FIG. 1, a dispenser 10 according to the teachings of the present invention comprises a dispenser case 11 having a lid 12 which is attached to the case by a hinge 13. The back of the case is attached to one or more wall mounting brackets 14. While the case depicted in FIG. 1 is shown as being generally cylindrical, it should be understood that a case of any shape or appearance is acceptable. The case includes a floor surrounded by upright side walls. The case may be molded in a variety of plastic materials. Polypropylene is considered particularly suitable because it allows the case 11 and lid 12 to be formed as a single unit with the hinge 13 integrally formed between the lid 12 and case 11. It should also be understood that the wall mounting brackets 14 are an optional feature which are provided solely for the convenience of allowing the dispenser to be located on an existing wall. The wall mounting brackets 14 may be omitted, in which case the dispenser is ideally suitable for placement on a desk, table, window sill or other flat surface.

The top 15 of the lid 12 is equipped with a central opening 16. The central opening 16 is sized to receive the dispenser tip 17 of a pump-type container or bottle 18. A peripheral skirt 19 surrounds the top 15 of the lid and at least a portion of the upper extremity of the case. The lid can have a uniform or non-uniform height "H". An important feature of the placement of the lid 12 is that there is sufficient clearance "C" between the lid 12 and the top 20 of the container 11 so as to allow the pump of the bottle 18 to be activated when the lid is depressed to contact and thus operate the pump. In alternative embodiment, the lid 12 may be hingedly attached to the upper wall mounting bracket 14.

Figure 2:
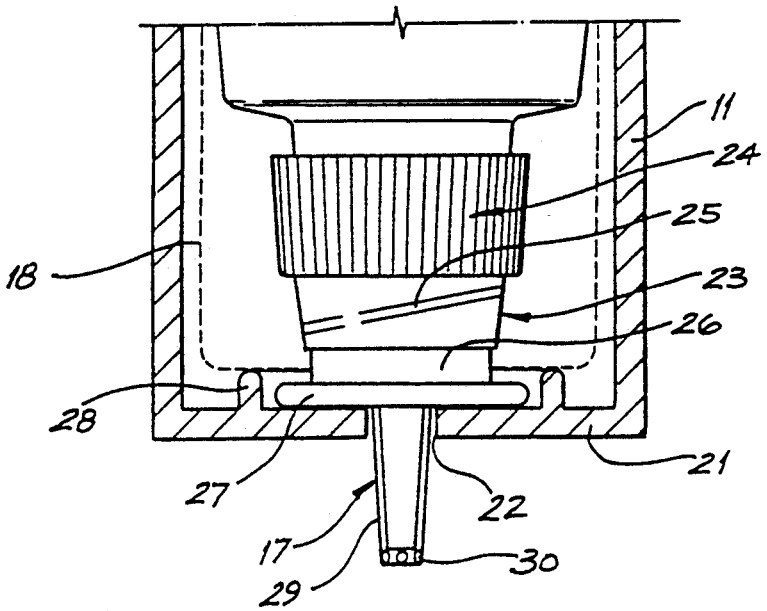
FIG. 2 is a partially cross-sectioned view of the base of a pump pack dispenser according to the teachings of the present invention.

As shown in FIG. 2, the bottom 21 of the case 11 may be equipped with a second type of central opening 22. The second type of opening is also sized to admit the dispensing nozzle 17 of a pump-type container. In this embodiment, when the lid 12 is depressed, it bears on the bottom of the bottle 18 which in turn activates the pump mechanism 23. In order for the pump mechanism 23 to work in the inverted position, an invertible or 360° valve may be provided within the pump-type container.

Figure 10:
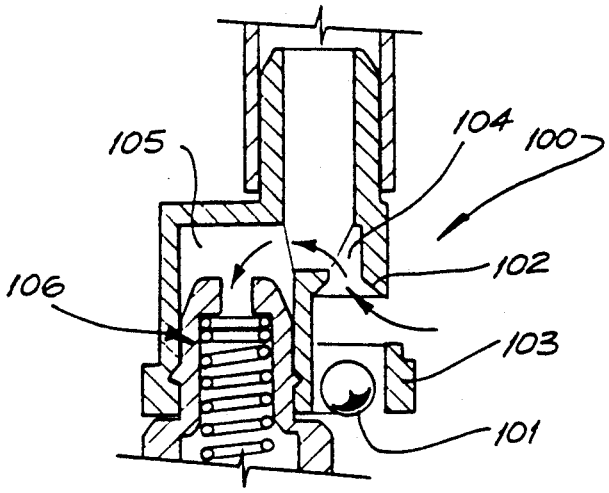
FIG. 10 shows a cross-sectional view of an invertible valve for dispensing liquids of various viscosities.
Figure 11:
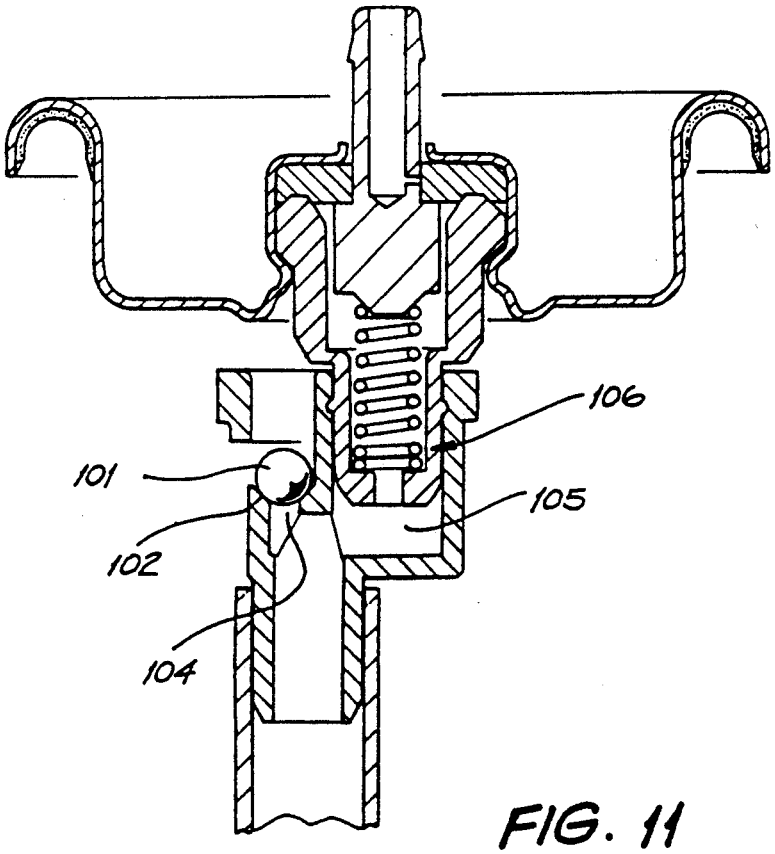
FIG. 11 shows in cross-section, the valve of FIG. 10 in the upright position.

An invertible or 360° valve arrangement is suggested in FIGS. 10 and 11. As shown in FIG. 11, when the valve 100 is inverted, a captive ball 101 drops from its seat 102 into a retainer 103. This exposes an orifice 104 through which liquid or lotion can enter the pumping chamber 105 and, in turn, pass through the valve piston and cylinder arrangement 106. Other invertible pumping valves may be utilised. In particular this embodiment of the invention is suitable for dispersing lotions or liquid soaps from pump of soft squeeze type bottles. In the alternative, a pumping valve assembly which is dedicated to inverted use may be provided to the pump-type container where the particular application calls for inverted use only.

As shown in FIG. 2, the pump-type container or bottle may include a screw top 24 having both internal threads for engaging the mouth of the container and external threads 25 for engaging the internal threads of a plastic cap. The pump piston 26 includes an integral flange 27. In the upright position, depressing the lid 12 directly activates the flange 27. In the inverted position, it is preferred that the flange be located within an upright rim 28 which at least partially surrounds the central opening 22 on the bottom 21 of the container 11. This prevents the bottom end of the bottle 18 from protruding too far out of the top 20 of the container 11 and interfering with the lid. It can be seen that the inside diameter or internal dimensions of the rim 28 are large enough to admit the flange 27, while the outside diameter of the rim 28 is smaller than the outside diameter of the bottle 18.

An additional feature of the invention is an improved dispensing tip. Most conventional elongated dispensing tips, such as those used in pump-type containers for nasal medication include a single dispensing orifice located at one extreme end of the nozzle. As shown in FIG. 2, the improved nozzle 17 of the present invention preferably includes an outer sleeve 29 which may be integrally formed with or detachable from the pumping apparatus. The outer sleeve 29 extends slightly beyond the tip of the dispensing nozzle and includes a plurality of preferably four, radial holes 30 in the side wall of the sleeve. The sleeve is open ended, so that when the pump is activated, a mist of fine particles is expelled from the nozzle. The provision of the exterior sleeve 29, owing to the venturi effect of the high speed mist passing through the sleeve tip, creates additional turbulence which serves to further disrupt and reduce the particle size of the dispensed liquid. The smaller particle size allows the particles or droplets to remain suspending in the air for a longer period of time.

Figure 3:
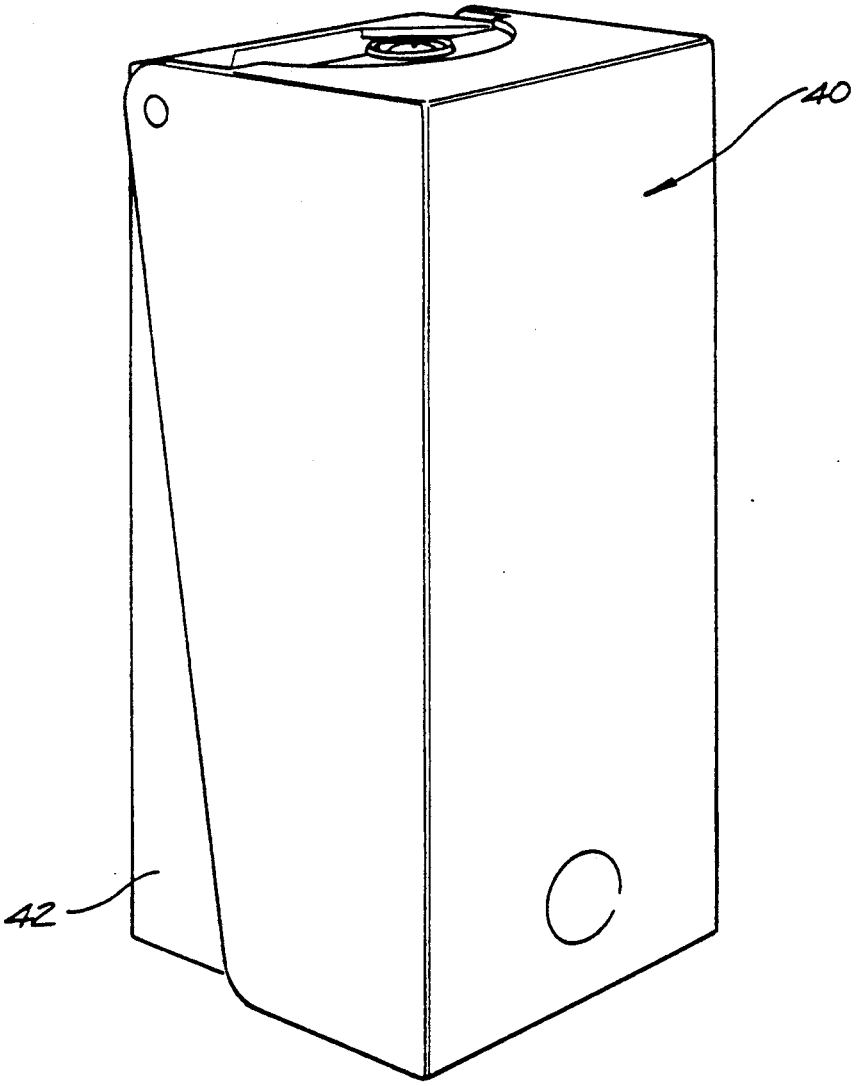
FIG. 3 is a perspective view of an alternative embodiment of a pump pack dispenser in a closed position.

As shown in FIG. 3, an alternative embodiment of the invention is designed to receive a flangeless pump-type container. Whereas the embodiment depicted in FIGS. 1 and 2 is designed to receive the pump-type container from the opened-ended top 20 of the container 11, the embodiments shown in FIGS. 3–9 and 12 include an enlarged lid or closure 40 which is intended to cover the open front 41 of the case 42 having a base **42*a* into which the flangeless pump-type container 43 is inserted, as shown in FIGS. 4, 5**.

Figure 4:
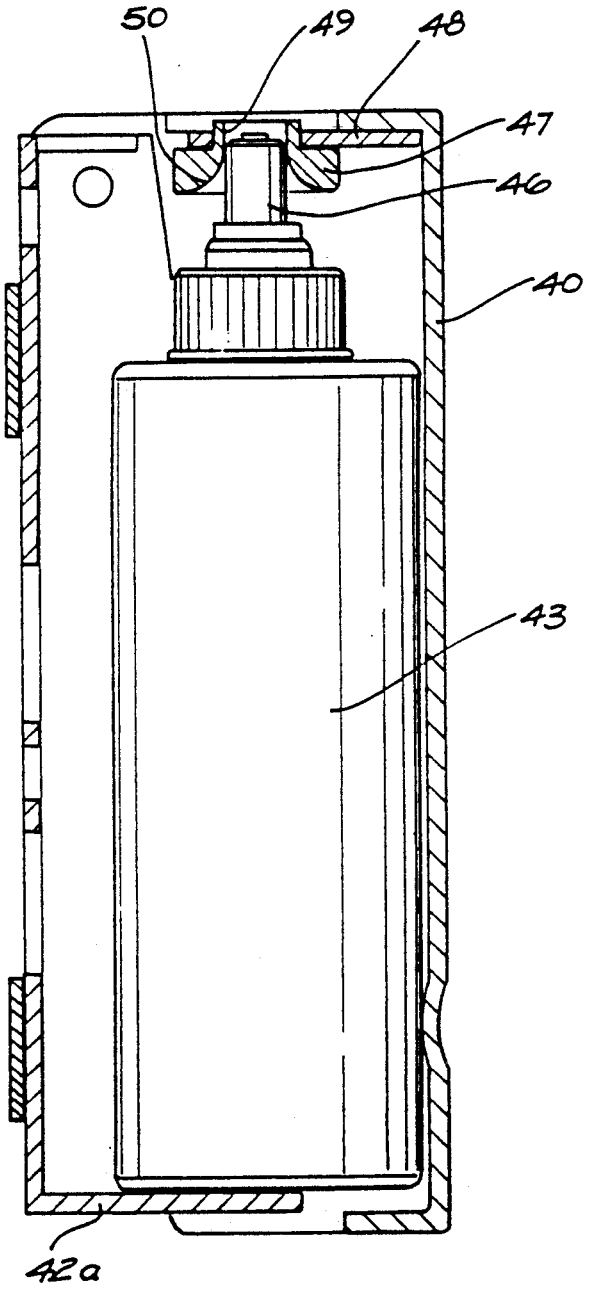
FIG. 4 is a partially cross-sectioned view of the dispenser of FIG. 3.
Figure 5:
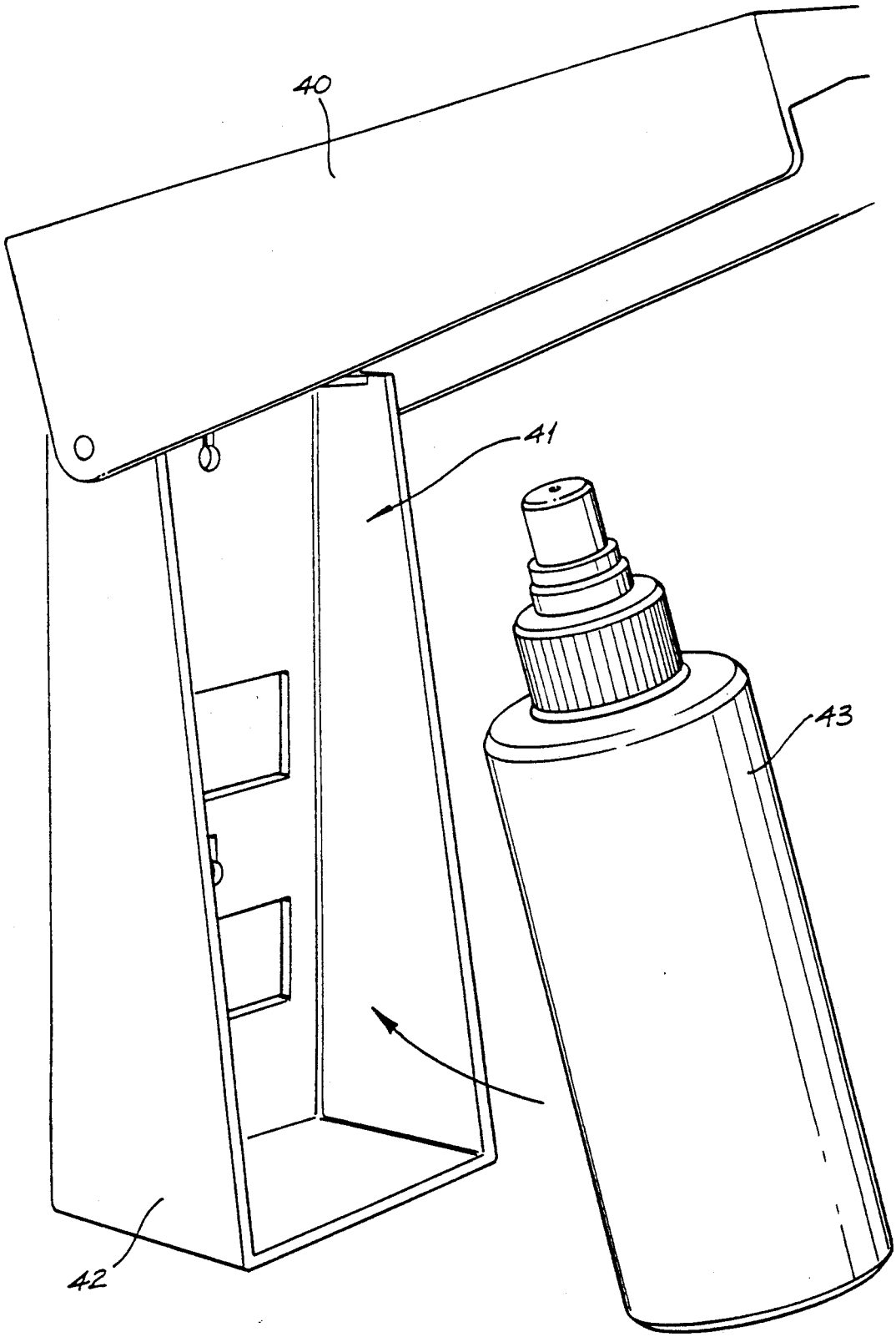
FIG. 5 is a perspective view of the dispenser of FIG. 3 in the open position.

As shown in FIG. 4, the nozzle 46 of the flangeless dispenser is inserted into a torroidal receptacle 47. The receptacle 47 is attached to the closure 40. An intermediate panel 48 may be used to fix the receptacle 47 to the closure 40. The receptacle 47 is characterised by a central cylindrical passageway 49 which snuggly receives the nozzle 46, including a pilot opening 50 with rounded edges. The pilot opening 50 both facilitates insertion of the nozzle 46 into the cylindrical opening 49 and allows the container 43 to pivot as shown in FIGS. 6 and 7.

Figure 6:
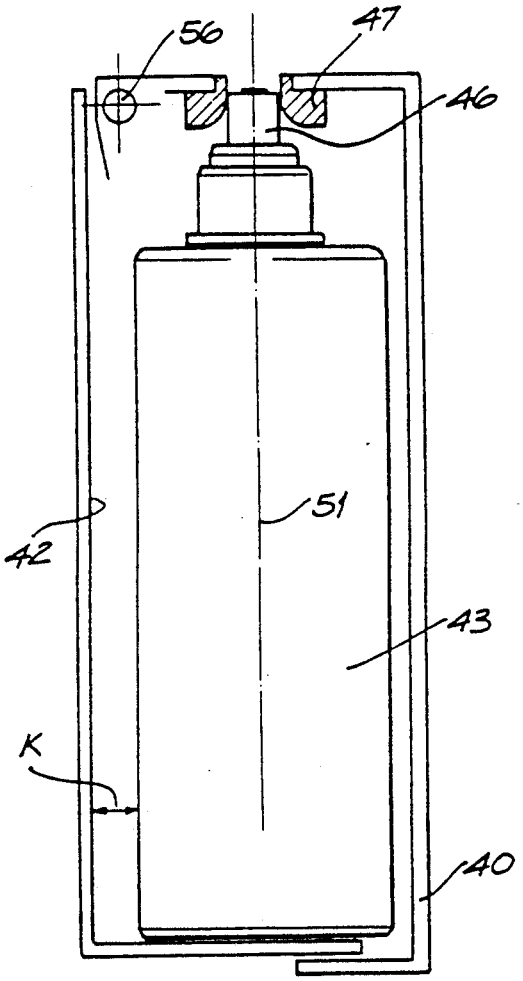
FIG. 6 is a partially cross-sectioned view of the dispenser depicted in FIG. 3.
Figure 7:
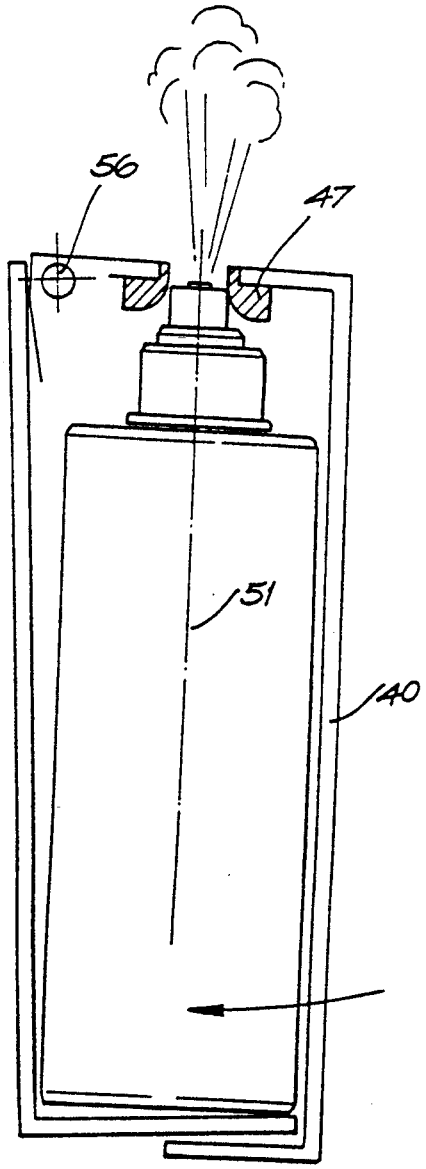
FIG. 7 is a partially cross-sectioned view of the dispenser depicted in FIG. 3.

As shown in FIG. 6, in the resting position, the container 43 is generally in the upright position. When the closure 40 is activated, clearance "K" between the container 43 and the rear of the case 42 allows the container 43 to pivot slightly as shown in FIG. 7. This minimises any bending effect on the nozzle 46 and keeps those forces imposed by the receptacle 47 onto the nozzle 46 generally aligned with the long axis 51 of the container 43.

Figure 8:
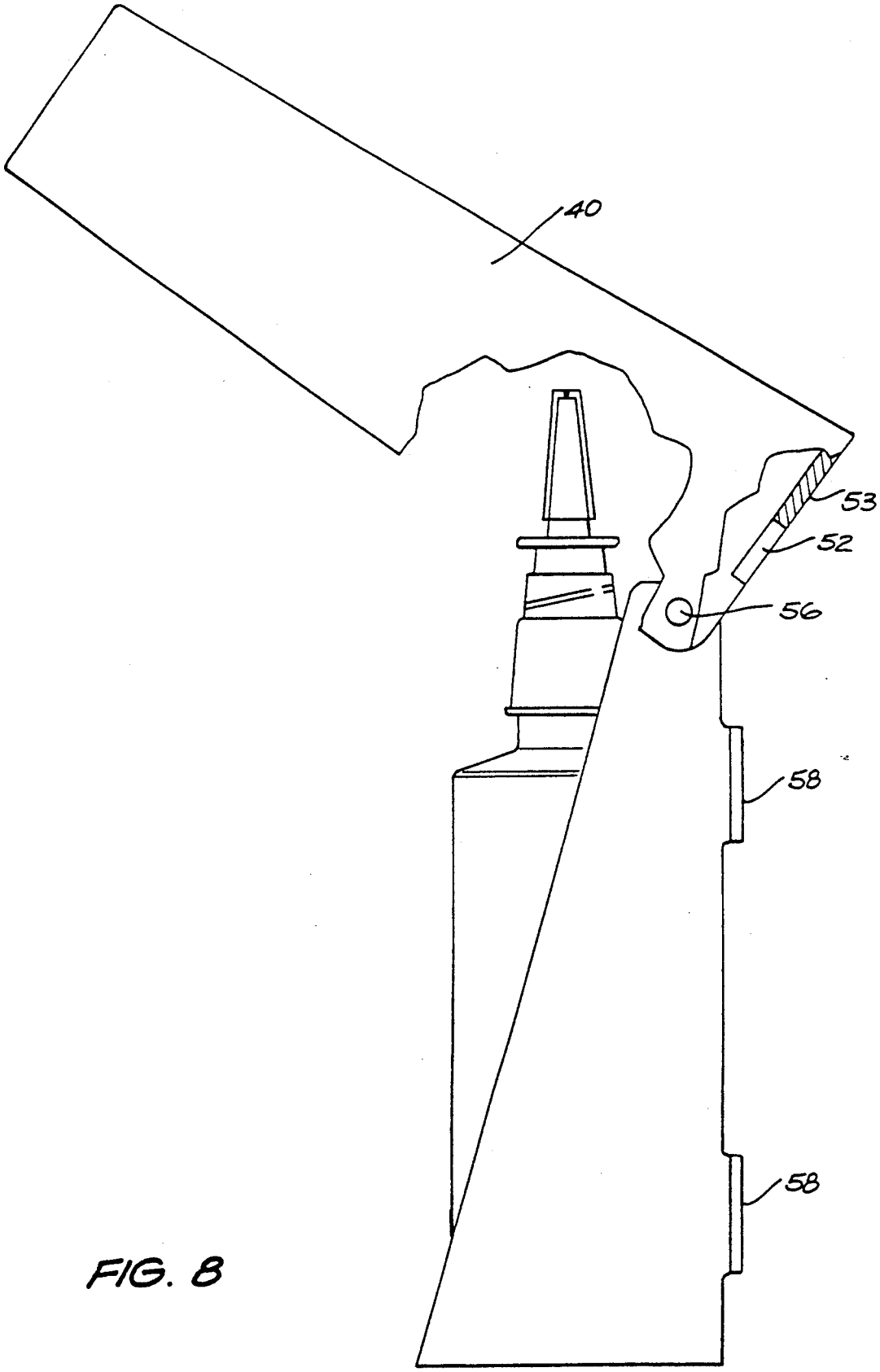
FIG. 8 is a side elevation, partially broken away, of the dispenser depicted in FIG. 3.

As shown in FIG. 8, the dispenser of the types generally illustrated in FIGS. 3–7 are easily adaptable to a pump-type container having a flange, of the type shown in FIGS. 1 and 2. In this instance, the closure 40 is provided with a central slot 52 located on the top surface 53, as shown in FIGS. 8–9.

Figure 9:
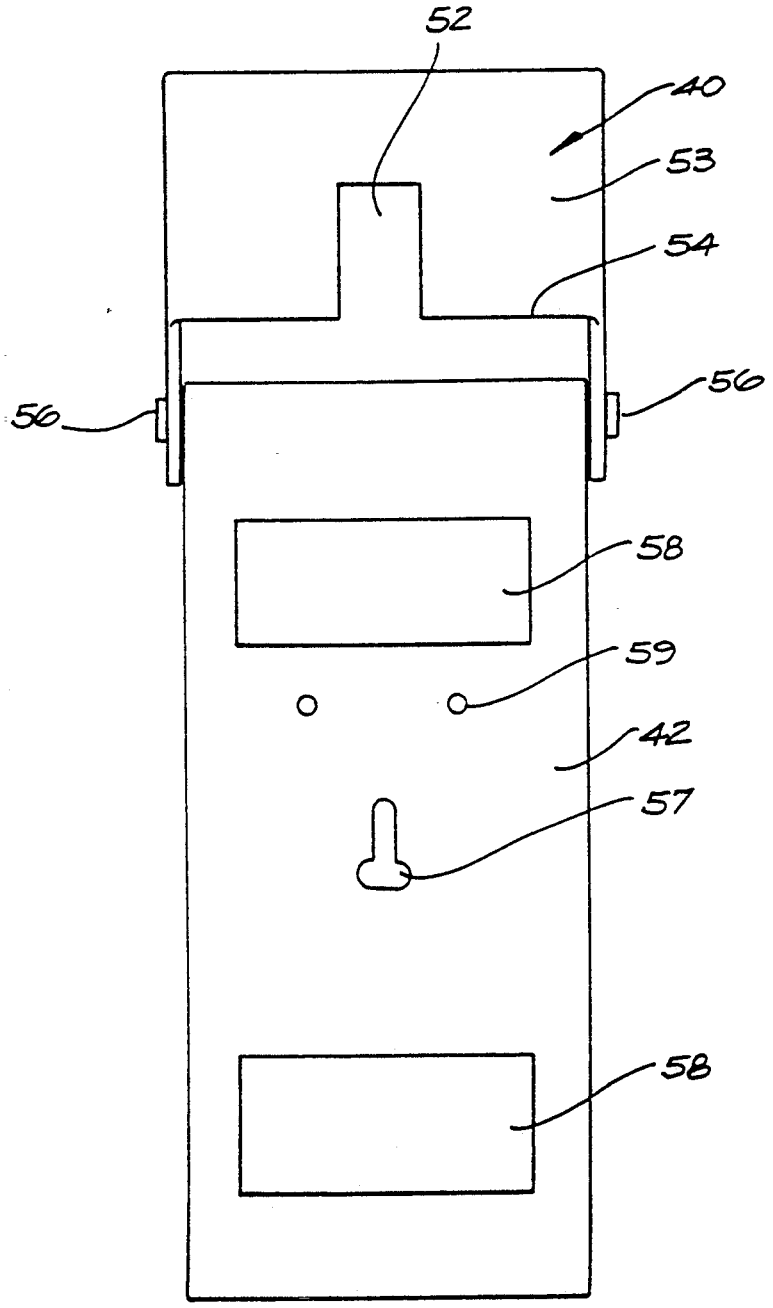
FIG. 9 is a rear elevation of the dispenser depicted in FIG. 3, with the lid partially open.

As shown in FIG. 9, the central slot 52 extends all the way to the rear 54 of the top portion 53. This allows the lid to close. Note that the top 40 is hinged at two locations, both designated 56, to the container 42. The case 42 is also equipped with a key hole shaped opening 57, self-adhesive pads 58 and mounting holes 59, any or all of which may be used for mounting the dispenser on the wall, if it is not used as a free standing unit on a flat surface.

Figure 12:
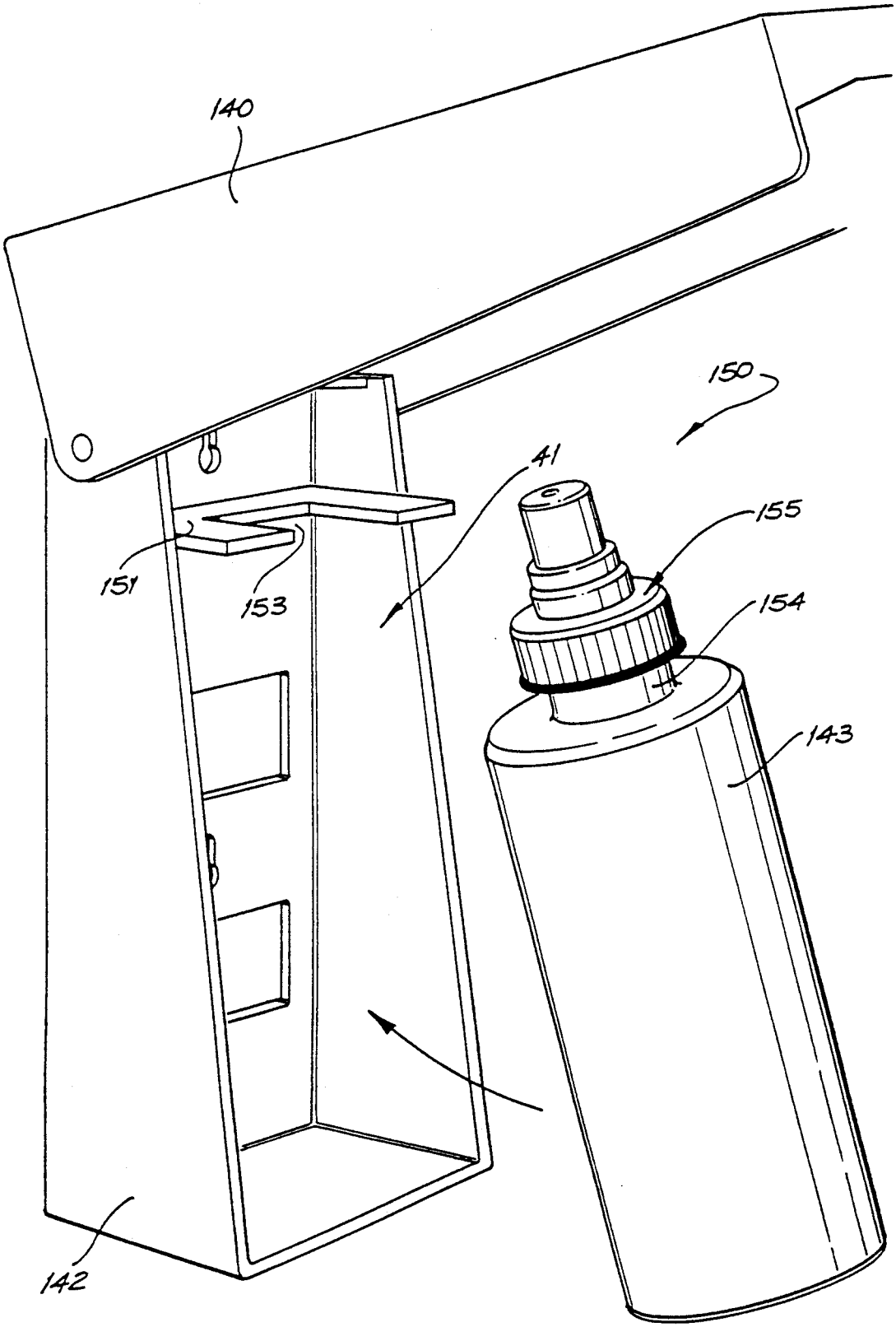
FIG. 12 shows a perspective view of a dispenser of a further embodiment of the present invention.

As shown in FIG. 12, an alternate embodiment 150 of the invention incorporates a shelf 151 which is rigidly attached to or integral with the case 142. The shelf 151 includes a central notch 153 which surrounds the neck 154 of a pump-type bottle 143. In this way, the bottle 143 is suspended from its cap and dispensing nozzle assembly 155 within the case 142. The shelf feature allows for easy insertion and pivotal motion of the container or bottle when activated by the hinged lid 140.

Figure 13:
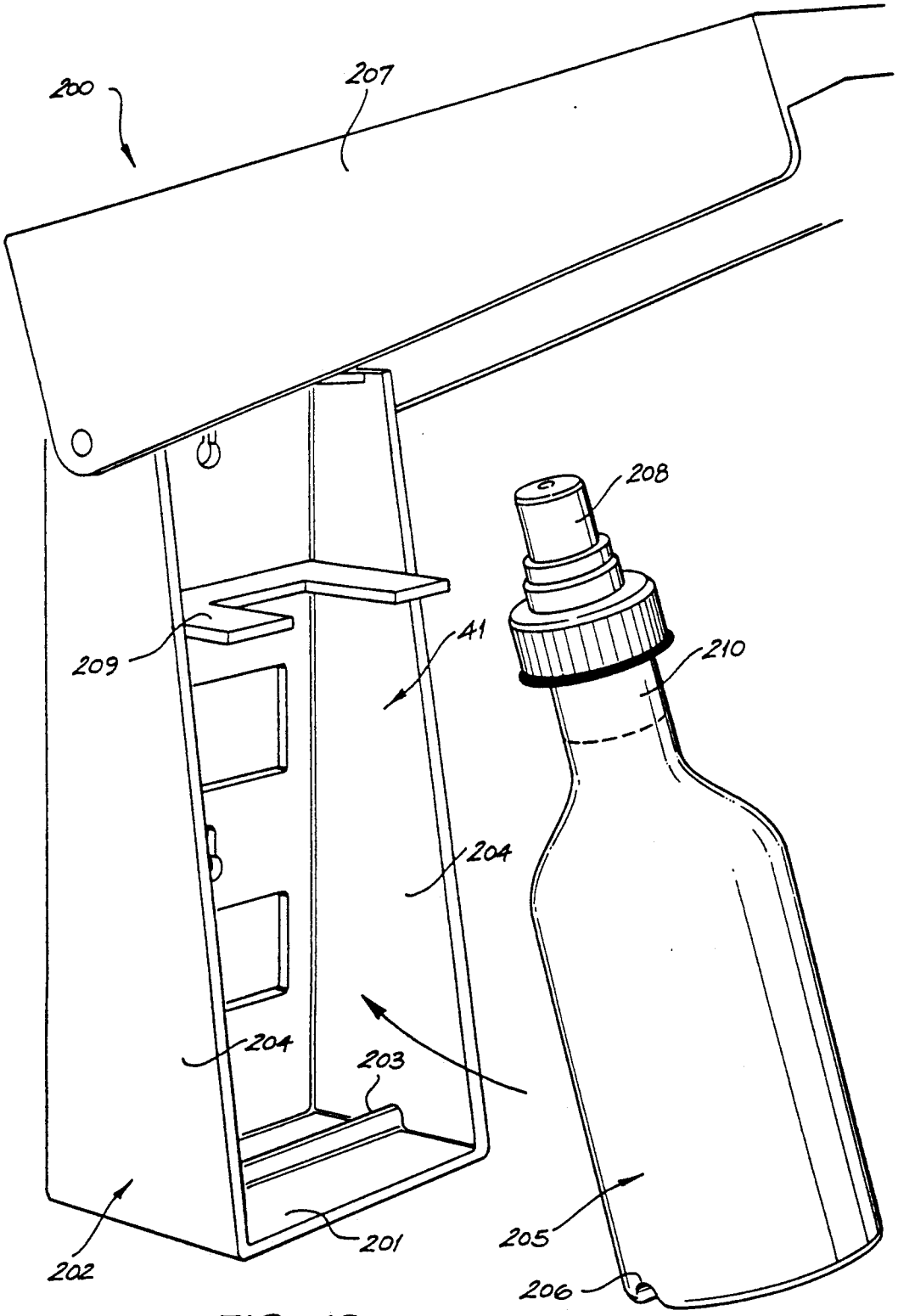
FIG. 13 is a perspective view of a still further embodiment of a dispenser of the present invention incorporating a supporting ridge on the floor of the case.
Figure 14:
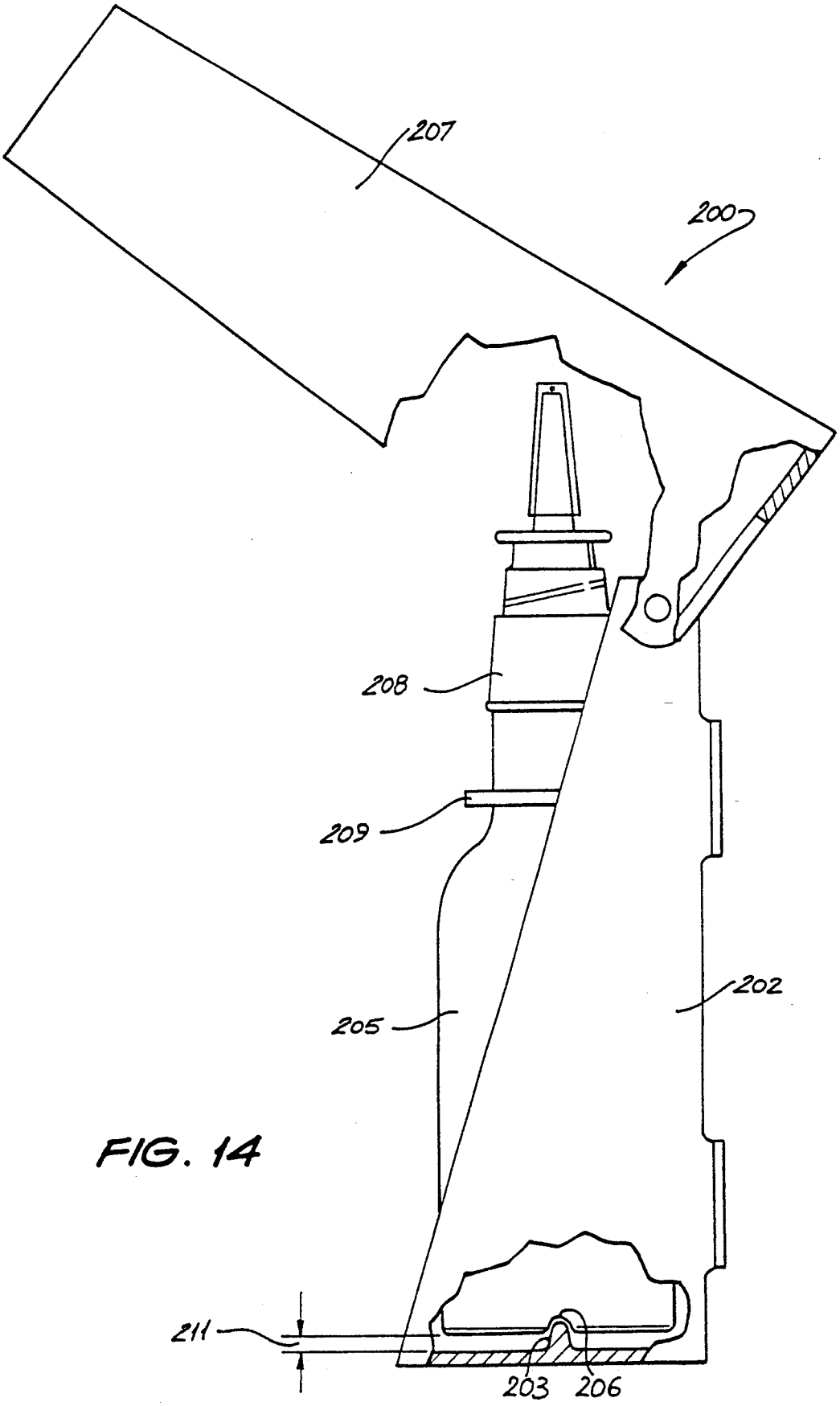
FIG. 14 is a side elevation, partially broken away, of the dispenser depicted in FIG. 13.

Yet another embodiment of the invention is depicted in FIGS. 13 and 14. The dispenser 200 is somewhat similar to the one shown in FIG. 12 except that the floor 201 of the case 202 is provided with an upstanding ridge 203. The ridge 203 extends at least part way between the side walls 204 of the case 202. This style of dispenser 200 is particularly adapted to receive a bottle 205 having a groove 206 formed in its base. The groove 206 preferably extends diametrically across the bottom of the base. Because the height of the ridge 203 is greater than the depth of the groove 206, the bottle 205 is supported by the ridge 203 and not the base 201 of the case 202. This allows the bottle to pivot backward and forward as the hinged cover 207 is depressed for the purpose of activating the pump mechanism 208. Because the bottle 205 is supported beneath the groove 206, an internal shelf 209, if used at all, would be used to laterally support the neck 210 of the bottle 205 at some point below the bottom of the pump mechanism 208. In this way, the pump mechanism would not interfere with the shelf 209 as the bottle pivoted backward and forward. As shown in FIG. 14, a gap 211 is provided between the base of the bottle 205 and the floor 201 of the case 202. This gap 211 accommodates the backward and forward pivoting of the bottle, when activated. This pivoting during activation promotes even contact between the pump mechanism 208 and the hinged case 207, thus promoting even wear characteristics between contacting parts and favourable dispensing characteristics.

Figure 15:
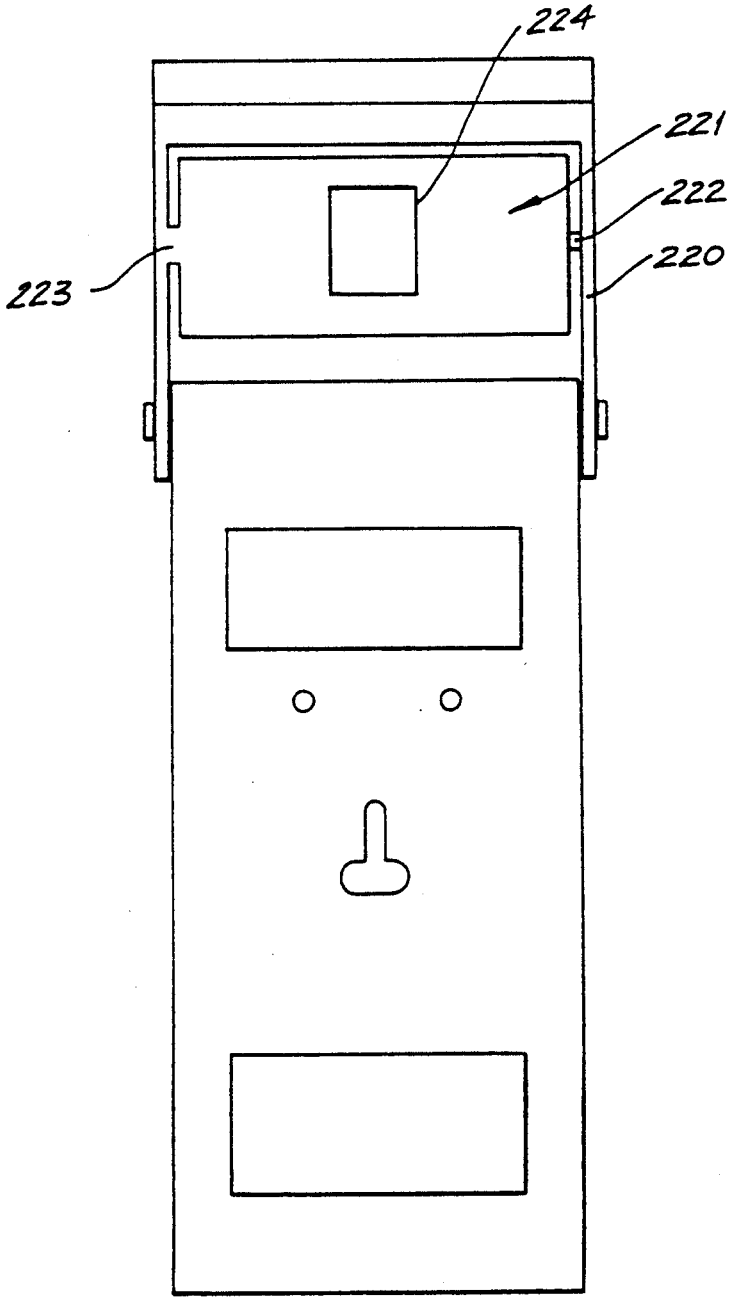
FIG. 15 is a rear elevation of a dispenser in which the hinged lid is provided with a pivoting plate having an aperture formed therein.

As shown in FIG. 15, a dispenser, for example of the type generally described with reference to FIGS. 3–9 and 12–14 may be advantageously modified by providing an upper portion of the hinged lid 220 with a pivoting plate 221. The pivoting plate may be provided flush with the top of the hinged lid 220 or may be concealed beneath it. The pivoting plate 221 may be attached to the hinged lid 220 by laterally extending pins 222. In the alternative, the pivoting plate 221 may be formed integrally with the hinged lid 220, for example by having an integral or "living" hinge 223 extending between an edge of the pivoting plate 221 and the hinged lid 220. The pivoting plate 221 includes an aperture 224 through which may protrude an elongated dispensing nozzle of the type depicted, for example, in FIGS. 1, 2 or 8. The pivoting plate 221 can be used in conjunction with or apart from the ridge 203 depicted in FIGS. 13 and 14. The purpose of the pivoting plate 221 is to maintain even contact with the pump mechanism of the bottle contained within the dispenser by pivoting relative to hinged lid 220 so as to remain essentially horizontal and thus essentially aligned in contact with the pump mechanism.

Figure 16:
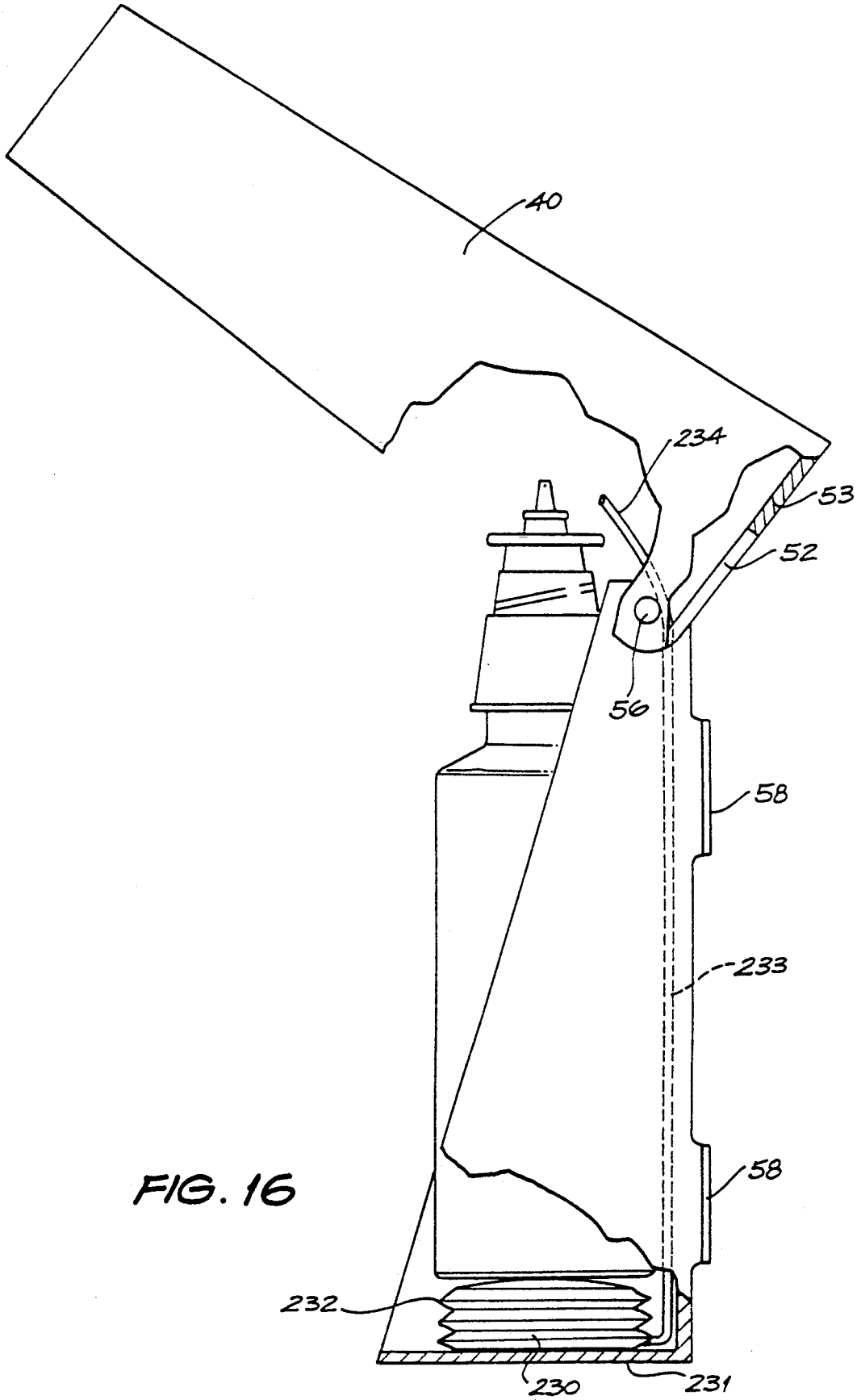
FIG. 16 is a side elevation, partially broken away, of a dispenser showing a pneumatic bulb.
Figure 17:
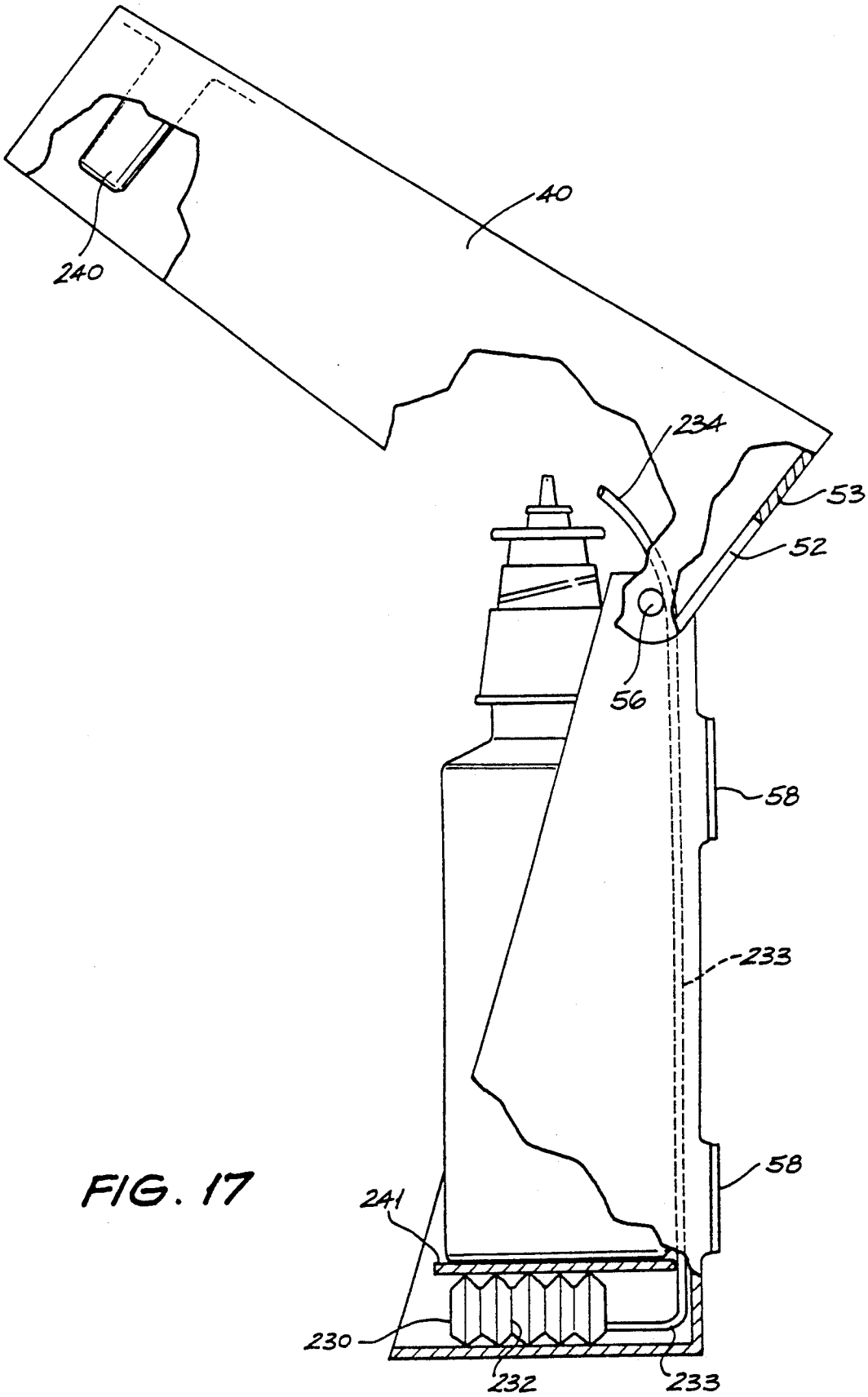
FIG. 17 is a side elevation, partially broken away, of a dispenser showing an alternate pneumatic bulb.

Another feature which can be utilized with any of the embodiments of the dispensers of the present invention is a pneumatic bulb. As shown in FIGS. 16 and 17, a pneumatic bulb 230 is located at the base or floor portion 231 within the case of a dispenser. The bulb 230 may be provided with or without accordion pleats 232. A tube 233 exits the bulb and extends to the upper end of the dispenser adjacent to the apertured opening through which the nozzle passes. The air delivery end 234 of the tube is directed towards the nozzle of the container held by the dispenser. When the lid is depressed to activate the pump mechanism, the bulb delivers a stream of air. The stream of air exiting the delivery end of the tube 234 helps dispense the mist, suspension or aerosol delivered by the container.

The bulb 232 may be mounted horizontally as shown in FIG. 17 or vertically as shown in FIG. 16.

If horizontal, the bulb may be activated by a cooperating plunger 240, located within and attached to the hinged closure 40. Preferably a lower internal shelf 241 supports the container.

Figure 18:
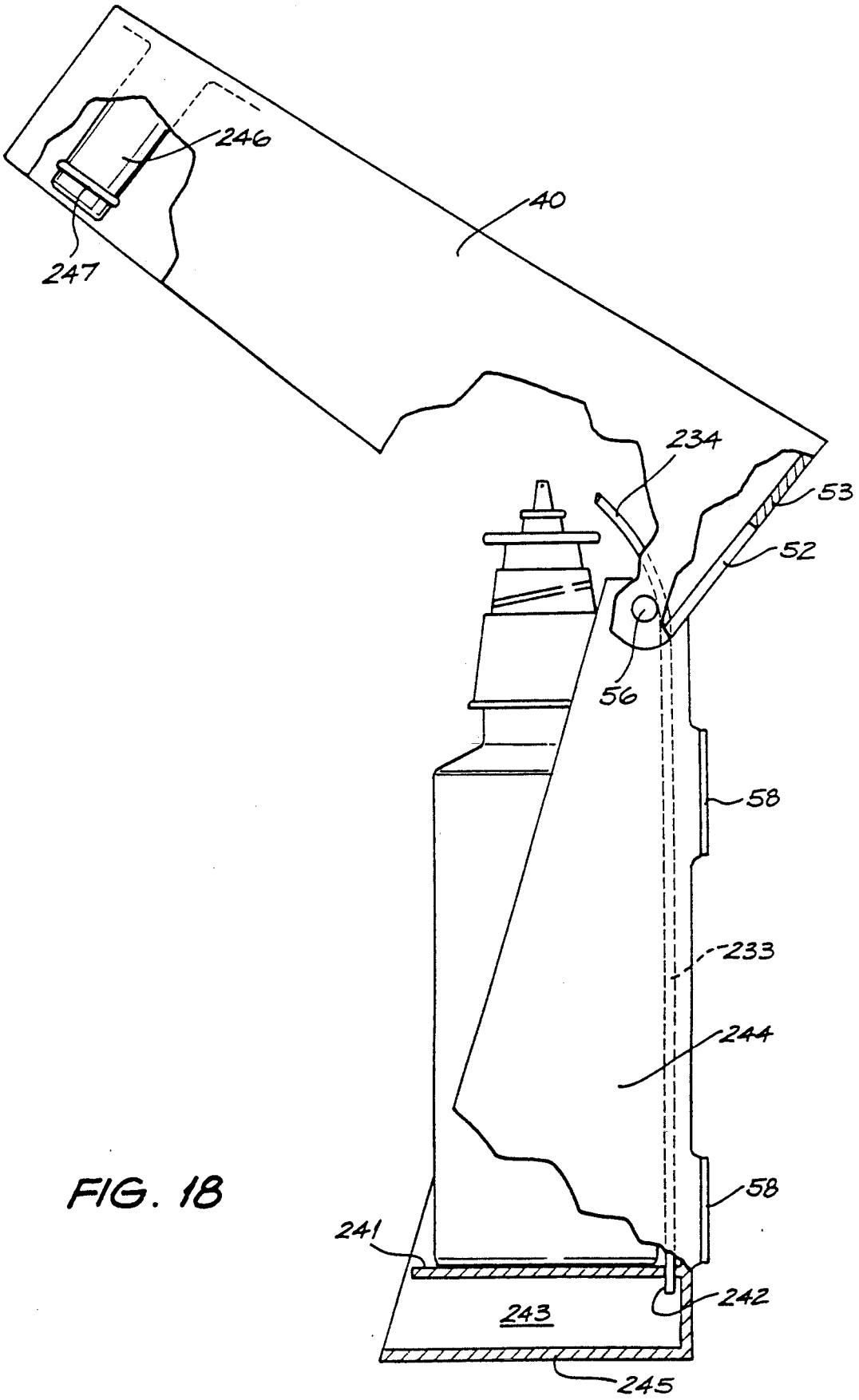
FIG. 18 is a side elevation, partially broken away, of a dispenser showing a piston and cylinder arrangement.

As shown in FIG. 18, a piston and cylinder arrangement may be provided to help dispense the mist, suspension or aerosol delivered by the container. As depicted in FIG. 18, the container may be supported by a shelf 241 within a lower portion of the case. A lower portion of the tube 242 terminates within a cylinder 243 formed between or separately within the side walls 244, the shelf 241 and the base 245. A piston 246 may be located within the hinged cover. The piston may include a seal 247. Thus, when the cover is closed and depressed, the piston compresses the air within the cylinder 243, delivering it through the opening 242 and into the tube 233 which passes through the shelf 241.

Figure 19:
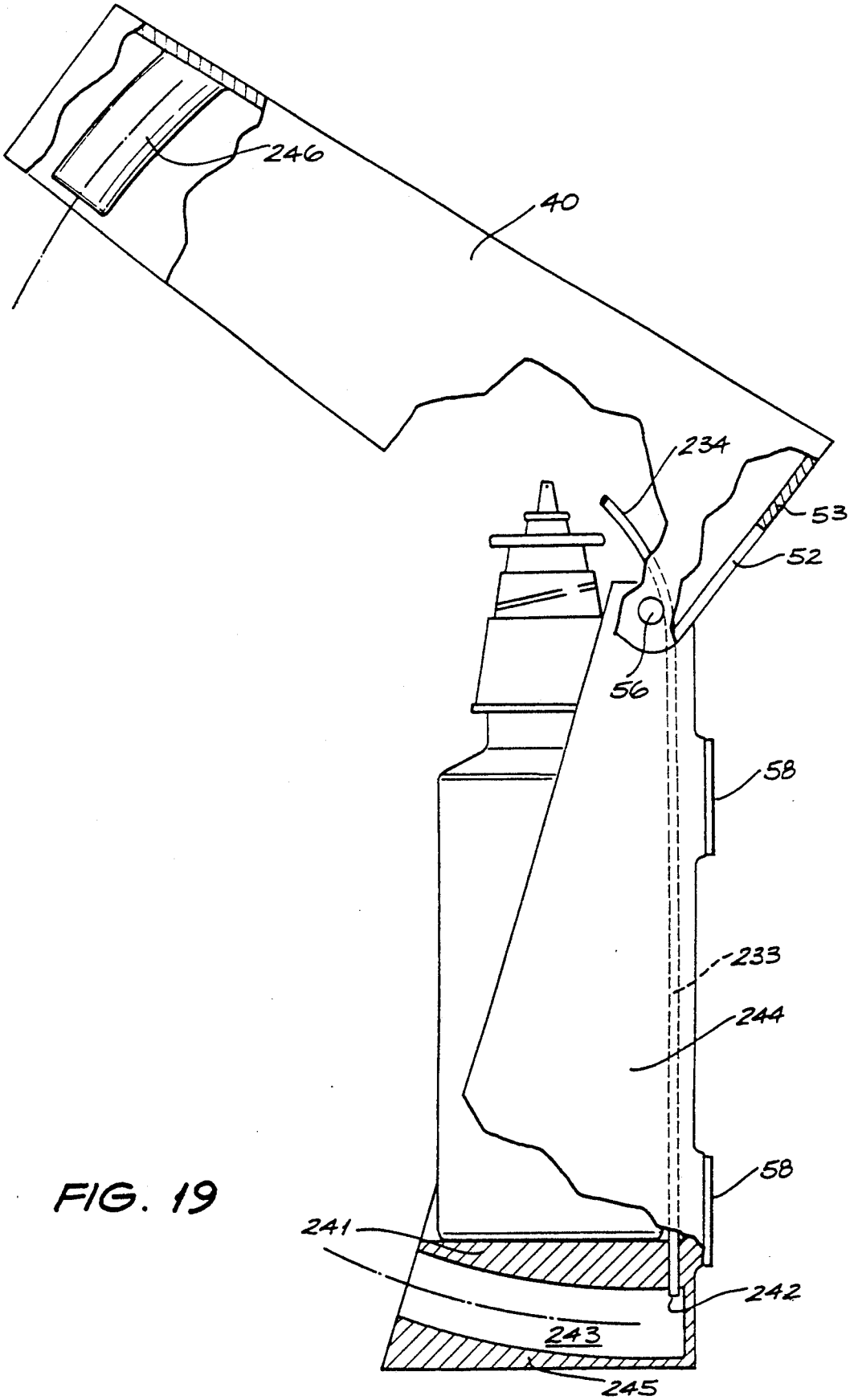
FIG. 19 is a side elevation, partially broken away, of a dispenser showing a curved piston and cylinder arrangement.

In the alternative, as shown in FIG. 19, the piston and cylinder 243, 244 may be curved about the center-line of the hinge 56. This would provide a smoother mechanical action and better seal.

It should be noted that the piston and cylinder arrangement may be formed integrally with the cover and case or may be formed separately and affixed to the cover and case.

It can be appreciated from the aforestated description that the dispenser of the present invention is adaptable to a wide variety of pump-type containers or bottles. These containers may be used in the upright position for dispensing medication, insect eradicator, dust mite allergy neutraliser, deodorants, or fragrances. In the inverted position, the dispenser of the present invention is particularly useful for dispensing soap, hand lotions, or cleansing products. The cases and lids of the dispensers of the present invention have been described with reference to specific shapes and materials, however these should be considered as examples and not limitations to the spirit or scope of the invention.

What I claim is:

1. A dispenser for a pump-type container, comprising:

a case having at least one wall mounting bracket, a floor surrounded by upright side walls, and a first aperture formed in the case floor and adapted to receive a nozzle of a pump-type container;

a lid hinged to the case and having a peripheral skirt at least partially covering an upper portion of the case, the lid having a rest position and a depressed position, with a clearance being provided between the lid and the case when the lid is in the rest position; and a second aperture formed in the lid and adapted to receive a nozzle of a pump-type container, such that the clearance between the lid and the case is sufficient to activate a pump mechanism of a pump bottle located within the case when the lid is depressed.

2. The dispenser of claim 1, wherein:

the second aperture is at least partially surrounded by an upright rim, the internal dimensions of the upright rim being large enough to admit a flange of a pump mechanism on a bottle which may be accepted by the dispenser, but which internal dimensions are smaller than the outside diameter of said bottle.

3. The dispenser of claim 1, wherein:

the apertured top portion of the lid further comprises a pilot opening with rounded edges.

4. The dispenser of claim 3, wherein, the pilot opening is displaced from a rear wall of the case far enough to allow said container to pivot when the lid is depressed.

5. The dispenser of any of claim 1, wherein:

the case further comprises an internal shelf, the shelf having a central notch formed therein.

6. In combination, the dispenser of claim 1 and a container;

the container further comprising a base having a groove formed therein, whereby the height of the ridge is greater than the depth of the groove.

7. A pump-type container adapted to be retained by a dispenser of the type of claim 1, comprising:

a bottle having a base, the base having formed therein a groove extending at least partially across a diameter of the base.

8. The container of claim 7, wherein the groove extends across the entire diameter of the base.

9. The container of claim 7, wherein:

the bottle further comprises an elongated nozzle;

the nozzle surrounded by an outer sleeve, the sleeve having a portion extending beyond a tip of the nozzle and having a plurality of radially disposed openings formed in said portion.

10. The container of claim 9, wherein the sleeve is detachable from the nozzle.

11. A dispenser for a pump-type container, comprising:

a case having a base, an interior, upright side walls, an open top and an open front;

the base of the case having an upright ridge extending at least partially between the upright side walls of the case;

a lid hinged to the case, and having an open position in which the interior of the case is accessible through the open front and a closed position in which the open top and front of the case are covered by the lid; and the lid having an apertured top portion adapted to activate a pump mechanism of a pump-type container located within the case when the lid is depressed.

12. A dispenser for a pump-type container, comprising:

a case having a base, an interior, upright side walls, an open top and an open front;

a lid hinged to the case, and having an open position in which the interior of the case is accessible through the open front and a closed position in which the open top and front of the case are covered by the lid; and the lid having an upper portion comprising a pivoting plate incorporating an apertured top portion adapted to activate a pump mechanism of a pump-type container located within the case when the lid is depressed.

* * * * *